United States Patent [19]

Levin et al.

[11] Patent Number: 4,604,680

[45] Date of Patent: Aug. 5, 1986

[54] INFRARED FLOODLIGHT

[75] Inventors: Robert E. Levin, S. Hamilton; George J. English, Reading, both of Mass.

[73] Assignee: GTE Products Corporation, Stamford, Conn.

[21] Appl. No.: 727,961

[22] Filed: Apr. 25, 1985

[51] Int. Cl.[4] ..... F21V 9/00

[52] U.S. Cl. ..... 362/293; 362/346; 362/347; 362/298; 313/113

[58] Field of Search ..... 362/293, 298, 346, 347; 313/113

[56] References Cited

U.S. PATENT DOCUMENTS

| | | | |
|---|---|---|---|
| 3,944,320 | 3/1976 | McLintic | 362/293 |
| 4,037,096 | 7/1977 | Brendgord et al. | 362/298 |
| 4,095,881 | 6/1978 | Maddox | 362/293 |
| 4,197,480 | 4/1980 | Ryan, Jr. et al. | 313/25 |
| 4,488,207 | 12/1984 | Harmon | 362/293 |

*Primary Examiner*—E. Rollins Cross
*Attorney, Agent, or Firm*—Lawrence R. Fraley

[57] ABSTRACT

An infrared floodlight assembly designed particularly for security purposes and including a heat-conducting housing, a lens secured to the housing to provide a closure therefor, and a floodlight located within (and surrounded by) the housing. The floodlight combines the use of a tungsten halogen light source and dichroic hot and cold mirrors for directing substantially only infrared radiation toward the assembly's forward lens. Visible radiation is absorbed by the housing's interior wall(s) and, optionally, by a filter located between the floodlight and lens. An optional means may be used within the floodlight to reflect all forward radiation back toward the paraboloidal hot mirror or, alternatively, to reflect only visible radiation in this direction. The dichroic hot and cold mirrors preferably each comprise a glass substrate having multiple layers of titanium dioxide and silicon dioxide thereon.

29 Claims, 6 Drawing Figures

INFRARED FLOODLIGHT

The Government has rights in this invention pursuant to Contract No. 96-3736, awarded by the U.S. Department of Energy.

TECHNICAL FIELD

This invention is in the field of floodlights and, more particularly, relates to infrared radiating floodlights.

BACKGROUND

Infrared floodlighting has significant application to security systems where it is often desirable to illuminate areas with infrared radiation not visible to the unaided human eye. Floodlighting of this type is particularly advantageous when used with closed circuit television surveillance equipment, but can also be used with direct passive viewing devices. Conventional infrared floodlights of the lens or reflector type typically utilize visible light-absorbing and infrared-transmitting filters located in front of the floodlight's lens to filter out visible light and pass infrared radiation therethrough. Since appreciable heat is absorbed by such filters, these known floodlights generally have been relative large for the wattages involved in order to minimize the power density at the filters. At times, forced cooling has been required. With very few exceptions, cost has limited the filters to the form of flat plates, which in turn increases the difficulty of producing wide beam spreads due to the increased absorption of rays which do not impinge normal to the filter. Consequently, not only is the visible radiation absorbed by such filters but certain infrared bands within the infrared spectrum are absorbed as well.

Accordingly, a need exists for an infrared floodlight assembly which is capable of handling the large radiant power required for such applications as infrared floodlight surveillance. It is believed that such a floodlight would constitute a significant advancement in the art.

DISCLOSURE OF THE INVENTION

It is, therefore, a primary object of the instant invention to enhance the art of infrared floodlighting and, particularly, to provide an infrared floodlight and floodlight assembly which overcome the aforementioned disadvantages of known floodlights of this type.

It is another object of this invention to provide an infrared floodlight and a floodlight assembly which can be manufactured on a mass production basis and at reasonable costs.

In accordance with one aspect of the present invention, an infrared floodlight is provided which is capable of absorbing a substantial amount of visible radiation while transmitting a substantial portion of infrared radiation. The floodlight comprises a light source (e.g., tungsten halogen lamp) which is disposed adjacent means for reflecting a substantial portion of the infrared radiation while passing (transmitting) the visible radiation from the light source therethrough. This means is also defined as a dichroic "hot mirror," since it reflects infrared ("hot") radiation and transmits visible ("cold") radiation. A means is also disposed on the side of the light source opposite the infrared reflecting means for transmitting infrared radiation while reflecting the cooler, visible radiation back toward the light source and the reflecting means behind said source. This latter means may also be defined as a dichroic "cold mirror."

In accordance with another aspect of the invention, there is provided a floodlight assembly which includes a heat conducting housing, a lens member secured to the housing and providing a cover therefor, and the aforementioned floodlight located within the housing. The housing, preferably metallic, may include an internal light-absorbing coating, such as black paint, to absorb a substantial portion of both the visible light as well as any ultraviolet radiation that may impinge on its surface. The cover lens member is located forward of the floodlight and is secured to the housing to completely enclose the floodlight.

An optional dichroic cold mirror may be provided within the floodlight between the light source and the forward cold mirror to reflect direct, forward emitted visible radiation from the light source back to the principal infrared reflecting means. As an alternative, this may be a solid (i.e., metallic) reflector which reflects substantially all of the light source's radiation. In addition, an absorbing filter which absorbs visible radiation may be disposed between the floodlight and lens cover to absorb any remaining traces of visible wavelengths, while still passing desired infrared radiation. Lastly, the lens cover may be provided with an internal beam spreading surface to provide a desired degree of beam spread for the floodlight.

A principal advantage of the invention is that the radiant power at the various filters, either reflecting or absorbing, is incident through only a limited range of angles of incidence. The wavelength absorbing or reflecting properties of filters depend, to a significant extent, on the angle of incidence. Thus, by substantially preventing the beam from spreading prior to filtering, the cut-off portion between transmission and reflection is extremely sharp in the present device. Furthermore, the visible light-absorbing filter is not subjected to the full power of the visible light radiation, since most of the visible radiation has been either reflected or transmitted back to the light-absorbing coating on the housing.

BEST MODE FOR CARRYING OUT THE INVENTION

Figure 1:
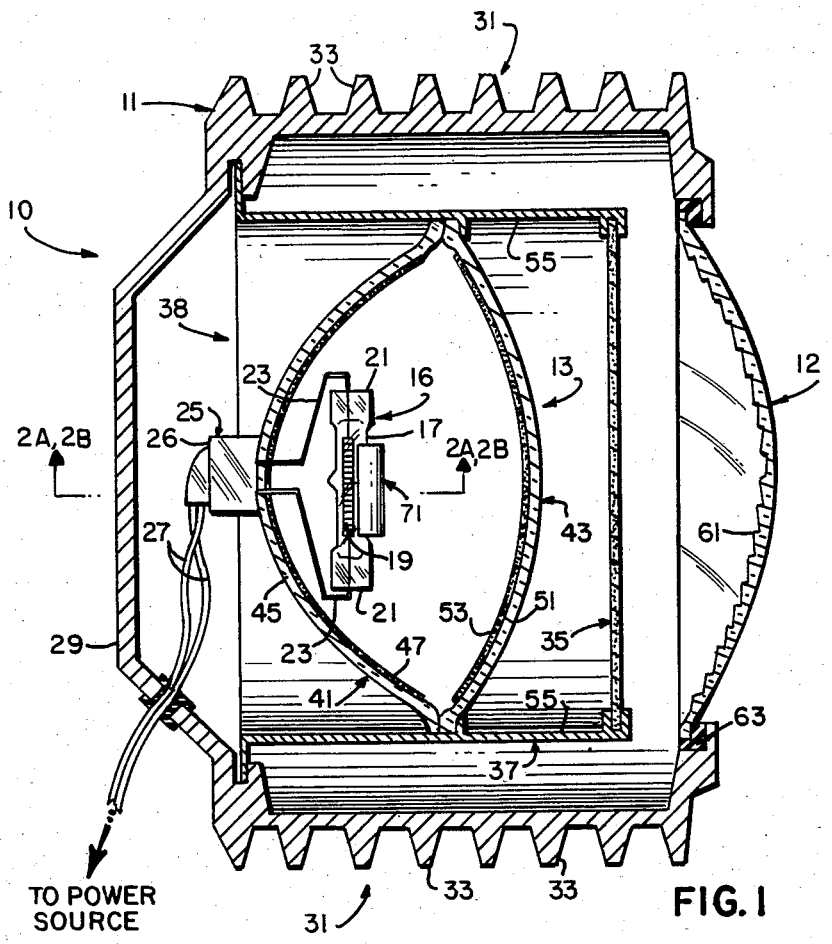
FIG. 1 is a side elevational view, partly in section, of an infrared floodlight assembly in accordance with a preferred embodiment of the invention.

With particular attention to FIG. 1, there is illustrated a floodlight assembly 10 in accordance with a preferred embodiment of the invention. Floodlight assembly 10 is designed for providing infrared radiation to a designated area (e.g., for purposes of surveillance).

Floodlight assembly 10 includes a housing 11, a lens member 12 for providing a cover for housing 11, and a floodlight 13 which is positioned within and surrounded by housing 11 and lens 12. Floodlight 13 includes a light source 16 which, in a preferred embodiment, comprised a compact, double-ended tungsten halogen lamp. Lamp 16 includes a quartz glass tube envelope 17 in which a coiled-coil tungsten filament 19 is centrally disposed between two opposed, terminal ends 21. A pair of conductive input lead wires 23 extend from respective ends 21 of lamp 16 through the rear of floodlight 13 to a socket means 25 to thereby enable connection of lamp 16 to an external power source (e.g., 120 VAC) for successfully igniting the lamp. Socket means 25, including the illustrated socket body 26, is electrically connected to the extending end sections of lead wires 23 and further includes electrical wiring 27 which passes through a rear wall 29 of housing 11.

A gas containing a halogen, such as bromine, iodine, chlorine or fluorine, is sealed within the quartz envelope 17 of lamp 16 to provide a halogen regenerative cycle which enables tungsten particles evaporated from the hot filament 19 to combine with the halogen to in turn form a halogen compound which enables the tungsten to be redeposited on the filament. Heat from the filament frees the halogen vapor which circulates to continue the regenerative cycle. This enables the quartz envelope to remain clean and free of tungsten particles, leading to the vastly longer life provided by tungsten halogen lamps. Tungsten halogen lamps are known in the art, with several types presently manufactured and sold by the assignee of this invention. It is preferred that filament 19 operate at the highest practical temperature. In this regard, it should be noted that the incandescent filament spectral power distribution is similar to that of a gray body. As the temperature is increased, the radiation peak shifts from the mid-infrared range to approximately the 800 to 1000 nanometer region. Understandably, the maximum temperature is limited by the lamp life since these are inverse functions. A long life is, of course, desired. In one example, filament 19 operated at a temperature of about 2950 degrees Kelvin, and lamp 16 possessed a corresponding lamp life of about 4000 hours. The spectral energy distribution of lamp 16 is similar to that of standard incandescent lamps with only a small percentage (e.g., ten to twelve percent) of the total energy being in the visible spectrum. Approximately seventy percent of the energy is in the infrared spectrum and about 0.2 percent is in the ultraviolet spectrum.

In the instant invention, infrared radiation emitted from floodlight 13 is directed toward and out a lens 12, which functions also as a cover, as explained above, and the visible radiation is directed back towards the rear wall 29 of housing 11, where it will be absorbed by an absorbing material, such as black paint (not shown), coated on the internal surface thereof. Housing 11 is metallic and thus of a sound heat conducting material. In one example, housing 11 was comprised of cast aluminum. To enhance heat removal, housing 11 further preferably includes heat dissipation means 31 in the form of several spaced fins 33 located about the main body portion of the housing. This body portion is preferably of cylindrical configuration.

It can also be seen in FIG. 1 that floodlight 13 and an optional visible absorbing filter 35 (if utilized) are retained within housing 11 using a cylindrical retainer 37 also of a sound heat conducting material. Retainer 37 includes a rear opening 38 for permitting ready access to floodlight 13 upon removal of rear wall 29. This rear opening, of course, also enables direct passage of visible radiation from the floodlight to the absorbing surface of wall 29.

As stated, and as further described in detail below, floodlight 13 combines the use of a dichroic hot mirror and a dichroic cold mirror in the manner described, each being substantially positioned on opposite sides of the floodlight's internal light source. As understood, the function of both mirrors is to direct infrared radiation forward (toward lens member 12) and the non-desired, visible radiation rearward (toward wall 29). These members thus act as interference filters with the described dichroic hot mirror functioning to reflect infrared radiation and transmit visible radiation while the dichroic cold mirror reflects visible and transmits infrared. By the term "transmits" as used herein is meant to allow to pass therethrough. With particular attention to FIG. 1, floodlight 13 includes such a dichroic hot mirror 41 with such a dichroic cold mirror 43 secured thereto or forming a part (i.e., extension) thereof. Mirror 41, located behind lamp 16, is preferably of paraboloidal configuration, while mirror 43, also curvilinear but located forward of lamp 16, functions to provide a closure for the open end defined by mirror 41. Mirror 41 includes a glass substrate 45 which has a multilayered dichroic coating 47 on the interior thereof.

Lamp 16 is located such that the coiled tungsten filament 19 is centered at or near the focal point of the paraboloidal mirror 41. Thus, light rays reflected from the dichroic coating 47 in a forward direction will be substantially collimated and comprised mainly of radiation in the infrared spectrum directed outwardly towards the spacedly oriented lens 12. Contrarily, light rays in the visible spectrum will be allowed to pass through both the dichroic coating 47 and the hard glass substrate 45 whereupon these rays will impinge on the light-absorbing coating of wall 29. Light radiation emitted from lamp 16 in the direction of lens 12, whether by reflection from mirror 41 or directly from lamp 16, must impinge directly on cold mirror 43. This mirror, also comprised of a hard glass substrate 51, such as Pyrex, and internally coated with a multilayered dichroic coating 53, is secured to or forms part of mirror 41. Preferably, mirror 43 is a separate member secured to mirror 41 by flame sealing or by using a suitable sealing cement. As indicated, internal coating 53 allows infrared radiation from lamp 16 to pass therethrough while simultaneously reflecting visible radiation back towards the paraboloidal mirror 41. Ultimately, this light reaches wall 29, where it is absorbed.

Although the flux reflected from the paraboloidal mirror 41 is nearly collimated, the direct flux from the lamp's filament 19 is not. This diverging component is an important contribution to wide beam distribution patterns. Consequently, retainer 37 is cylindrical and includes an internal reflective surface 55 which is used to space filter 35, if used, from the floodlight. The diverging rays incident to these reflecting surfaces are reversed in direction with respect to the centerline but are retained within the same total beam spread. This feature maintains a relatively high efficiency for the instant invention.

It is understood from the foregoing that mirrors 41 and 43 combine to form a sealed lamp cavity. To protect the metallic leads 23 from possible contamination, this cavity is evacuated of oxygen during assembly and nitrogen or some other inert gas introduced at about one-third atmosphere.

Dichroic coatings 47 and 53 comprise multiple layers of titanium dioxide ($TiO_2$) and silicon dioxide ($SiO_2$). In one example, a total number of 25 layers of each material was provided. The number of layers and/or types of coating materials utilized depends on the corresponding requirement of the element in question. Thus, by selecting materials such as described above, and by selectively layering such materials, it is possible to "tune" each element to the incoming (impinging) radiant energy to in turn perform the function desired (i.e., reflect or transmit infrared).

Floodlight assembly 10 may also include the aforementioned filter 35. Filter 35, being substantially planar and located between mirror 43 and lens 12, functions to absorb any miscellaneous visible radiation which may escape and is not absorbed by housing 19, while allowing infrared energy to pass therethrough. The principal function of the absorption filter 35 is to provide visual security. Since it is possible to visually detect radiation above 780 nanometers at sufficiently high power levels, absorption filter 35 preferably has a 50 percent cut-on wavelength at 830 nanometers with approximately a two percent transmittance at 800 nanometers. For those instances where complete visual security is unessential, a filter with about a 50 percent cut-on at approximately 800 nanometers can be used with an increase of about 35 percent in the near-infrared intensity. The steady state temperature rise of filter 35 is approximately 275 degrees Celsius above ambient. In one embodiment, filter 35 was a temperature colored glass filter and, as such, possessed a reversible shift of the absorption edge toward longer wavelengths with a corresponding increase of temperature. This was on the order of about 0.2 nanometer per degree Celsius.

To further assure prevention of visible radiation escape, the interior of housing 11 is darkened (painted black) entirely to the location of intersection with lens 12. This has proven successful in absorbing substantially all of such stray and undesired illumination. Preferably, the interior surface of housing 12 also includes a non-smooth surface by utilizing a plurality of ribs or other corrugations (not shown) to further enhance radiation trapping. Thus, an appreciable portion of the power emitted by lamp 16 is absorbed by the housing. The housing's outer surface has also been substantially increased for heat dissipation by providing the aforedescribed fins 33 thereon.

As shown in FIG. 1, lens 12 is provided with an internal lenticular surface 61 to provide the desired degree of beam spread for floodlight assembly 10. A rubber gasket 63 or other means known in the art is provided to secure the lens to housing 12 in a watertight fashion.

Figure 2A:
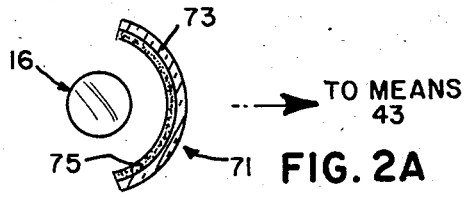
FIGS. 2A and 2B, taken along the line 2A, 2B—2A, 2B in FIG. 1, represent alternative embodiments of an optional reflectance means for use in the invention.
Figure 2B:
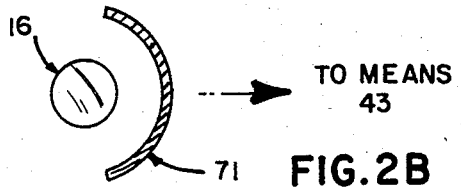

An optional means 71 may be provided within floodlight 13 forward of lamp 16 (and thus between the lamp and mirror 43) to either reflect all direct radiation from the lamp away from mirror 43 and toward paraboloidal mirror 41 or, alternatively, to reflect only visible radiation toward mirror 41. Means 71 may be either flat or curved (as shown), depending on the specific radiation control desired. In the former embodiment (FIG. 2A), means 71 preferably includes a glass substrate 73 with a dichroic coating 75 which, if used, is of the same materials as used in coatings 47 and 53. In the latter embodiment (FIB. 2B), means 71 may be simply a curved opaque metallic member. In both cases, means 71 aligns with filament 19 as indicated in FIG. 1.

Figure 3A:
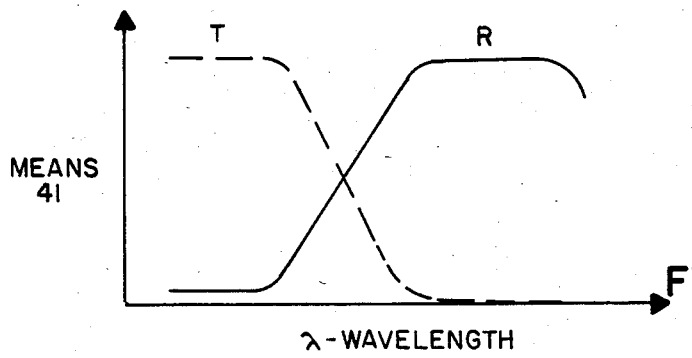
FIGS. 3A–3C illustrate plots of the idealized filtering characteristics of the infrared reflecting means (hot mirror), visible reflecting means (cold mirror), and visible absorbing means of the invention, respectively. These characteristics (R for reflecting and T for transmitting) are shown as a function of wavelength.
Figure 3B:
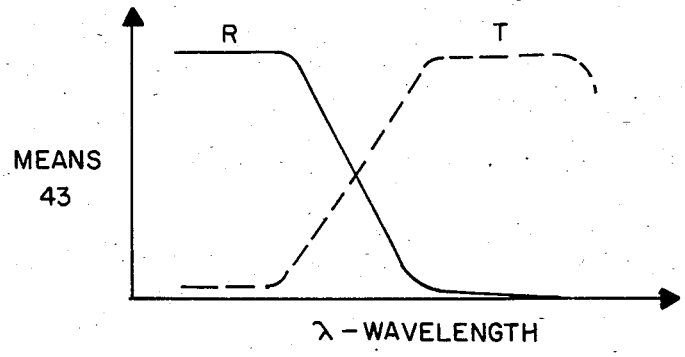
Figure 3C:
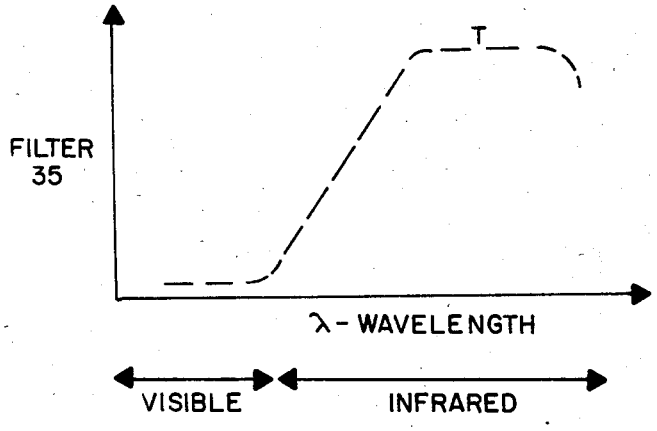

Graphs are provided in FIGS. 3A–3C to illustrate the idealized infrared filtering characteristics of the invention's dichroic hot mirror 41 (FIG. 3A), the dichroic cold mirror 43 (FIG. 3B), and the visible-absorbing filter 35 (FIG. 3C) as a function of wavelength. The reflecting characteristics are labelled "R" and the transmitting characteristics "T." These graphs are arranged in a vertical orientation to more closely compare the characteristics of these components of the invention relative to each other. It is also understood that the graph in FIG. 3B represents the characteristics for means 71, if utilized and of the type illustrated in FIG. 2A (having a glass substrate and dichroic coating thereon).

There has thus been shown and described an infrared floodlight assembly and floodlight for use therein wherein substantially all of the visible radiation produced by the assembly is internally absorbed through the utilization of hot and cold dichroic mirrors and suitable absorbing means such that substantially only infrared radiation is emitted. The invention is able to utilize a conventional light source (i.e., tungsten halogen lamp). By strategically positioning the various internal components as defined above, the invention substantially prevents excessive beam spread prior to filtering, to thereby enhance operation thereof. The assembly is thus also able to utilize an internal filter (visible-absorbing) that is not subjected to extreme amounts of visible radiation. It is also understood that the floodlight 13 as defined herein may, in its simplest form, be used exclusive of housing 11 and lens 12 to provide a source of infrared radiation. For example, floodlight 13 could be retained in a suitable holder with some visible-absorbing means other than rear wall 29 located therebehind to collect undesirable radiation escape.

While there have been shown and described what are at present considered the preferred embodiments of the invention, it will be obvious to those skilled in the art that various changes and modifications, in addition to those described, may be made therein without departing from the scope of the invention as defined by the appended claims. For example, it is within the scope of the invention to place the defined dichroic coatings 47 and 53 externally of the illustrated substrates (45 and 51, respectively) and still provide the required reflecting and transmitting functions. It is also possible to utilize a non-planar (e.g., curvilinear) visible-absorbing filter in place of the planar filter 35. To further reduce heat buildup on filter 35, it is also possible to extend the distance between this component and the curvilinear cold mirror 43.

What is claimed is:

1. An infrared floodlight comprising:

a light source for providing infrared radiation;

means located substantially on one side of said light source for reflecting infrared radiation from said light source and for transmitting visible radiation from said light source therethrough; and means secured to or forming part of said infrared reflecting means to provide a closure therefor, said closure means transmitting infrared radiation from said light source and from said infrared reflecting means therethrough and reflecting visible radiation toward said infrared reflecting means.

2. The floodlight according to claim 1 wherein said light source is a tungsten halogen lamp having a coiled tungsten filament therein.

3. The floodlight according to claim 1 wherein said infrared reflecting means comprises a glass substrate having a dichroic coating therein.

4. The floodlight according to claim 3 wherein said dichroic coating comprises multiple layers of titanium dioxide and silicon dioxide.

5. The floodlight according to claim 3 wherein said infrared reflecting means is of a substantially paraboloidal configuration.

6. The floodlight according to claim 3 wherein said visible reflecting closure means comprises a glass substrate having a dichroic coating thereon.

7. The floodlight according to claim 6 wherein said dichroic coating comprises multiple layers of titanium dioxide and silicon dioxide.

8. The floodlight according to claim 6 wherein said visible reflecting closure means is of substantially curvilinear configuration.

9. The floodlight according to claim 1 further including means located between said light source and said visible reflecting closure means for reflecting visible radiation from said light source toward said infrared reflecting means and for transmitting infrared radiation therethrough.

10. The floodlight according to claim 9 wherein said visible reflecting means located between said light source and said visible reflecting closure means comprises a glass substrate having a dichroic coating thereon.

11. The floodlight according to claim 1 further including means located between said light source and said visible reflecting closure means for reflecting infrared and visible radiation from said light source toward said infrared reflecting means.

12. The floodlight according to claim 11 wherein said visible and infrared reflecting means comprises a curvilinear opaque member located adjacent said light source.

13. An infrared floodlight assembly comprising:

a heat conductive housing defining an open end;

a lens member secured to said housing and providing a cover for said open end; and an infrared floodlight located within said housing, said floodlight including a light source for providing infrared radiation, means located substantially on one side of said light source for reflecting infrared radiation from said light source and for transmitting visible radiation from said light source therethrough, and means secured to or forming part of said infrared reflecting means to provide a closure therefor, said closure means transmitting infrared radiation from said light source and from said infrared reflecting means therethrough and reflecting visible radiation toward said infrared reflecting means.

14. The floodlight assembly according to claim 13 further including filter means for absorbing visible radiation located within said housing between said lens member and said infrared floodlight.

15. The floodlight assembly according to claim 13 wherein said housing includes heat dissipating means thereon.

16. The floodlight assembly according to claim 13 wherein said housing includes an internal surface having visible radiation absorbing material thereon.

17. The floodlight assembly according to claim 13 wherein said lens member is of substantially curvilinear configuration and includes an internal lenticular surface for diffusing infrared radiation passing through said lens member.

18. The floodlight assembly according to claim 13 wherein said light source of said floodlight is a tungsten halogen lamp having a coiled tungsten filament therein.

19. The floodlight assembly according to claim 18 wherein said light source includes a pair of metallic, conductive lead wires passing externally of said floodlight, said housing further including an atmosphere therein for substantially protecting said lead wires from contamination.

20. The floodlight assembly according to claim 19 further including socket means connected to said lead wires within said housing, said socket means including electrical wiring passing through said housing.

21. The floodlight assembly according to claim 13 wherein said infrared reflecting means of said floodlight comprises a glass substrate having a dichroic coating thereon.

22. The floodlight assembly according to claim 21 wherein said dichroic coating comprises multiple layers of titanium dioxide and silicon dioxide.

23. The floodlight assembly according to claim 21 wherein said infrared reflecting means is of a substantially paraboloidal configuration.

24. The floodlight assembly according to claim 13 wherein said visible reflecting closure means comprises a glass substrate having a dichroic coating thereon.

25. The floodlight assembly according to claim 24 wherein said dichroic coating comprises multiple layers of titanium dioxide and silicon dioxide.

26. The floodlight assembly according to claim 13 further including means located within said floodlight between said light source and said visible reflecting closure means for reflecting visible radiation from said light source toward said infrared reflecting means and for transmitting infrared radiation therethrough.

27. The floodlight assembly according to claim 26 wherein said visible reflecting means located within said floodlight between said light source and said visible reflecting closure means comprises a glass substrate having a dichroic coating thereon.

28. The floodlight assembly according to claim 13 further including means located within said floodlight between said light source and said visible reflecting closure means for reflecting infrared and visible radiation from said light source toward said infrared reflecting means.

29. The floodlight assembly according to claim 28 wherein said visible and infrared reflecting means within said floodlight comprises a curvilinear opaque member located adjacent said light source.

* * * * *